US006017237A

United States Patent [19]

Sullivan

[11] Patent Number: 6,017,237

[45] Date of Patent: Jan. 25, 2000

[54] TWISTED-PAIR DATA CABLE WITH ELECTRICAL CONNECTOR ATTACHED

[76] Inventor: Robert W. Sullivan, 3310 Los Nogales Rd., Simi Valley, Calif. 93063

[21] Appl. No.: 08/787,023

[22] Filed: Jan. 28, 1997

Related U.S. Application Data

[60] Provisional application No. 60/024,593, Aug. 26, 1996.

[51] Int. Cl.[7] ..... H01R 4/24

[52] U.S. Cl. ..... 439/392; 439/941; 439/418

[58] Field of Search ..... 439/418, 392, 439/425, 354, 344, 404, 941, 676

[56] References Cited

U.S. PATENT DOCUMENTS

| | | | |
|---|---|---|---|
| 3,761,869 | 9/1973 | Hardesty et al. | 439/418 |
| 3,860,316 | 1/1975 | Hardesty | 439/418 |
| 3,954,320 | 5/1976 | Hardesty | 439/418 |
| 4,002,392 | 1/1977 | Hardesty | 439/418 |
| 4,054,350 | 10/1977 | Hardesty | 439/418 |
| 4,569,566 | 2/1986 | Triner | 439/392 |
| 5,727,962 | 3/1998 | Caveney et al. | 439/344 |
| 5,772,465 | 6/1998 | Hwang et al. | 439/418 |
| 5,906,503 | 5/1999 | Wiencek et al. | 439/418 |

*Primary Examiner*—Paula Bradley
*Assistant Examiner*—Tho D. Ta
*Attorney, Agent, or Firm*—Gene W. Arant; Larry D. Baker

[57] ABSTRACT

Electrical apparatus for connecting insulated wires of a multi-pair electrical cable to an outlet, including a connector having an opening which receives a plurality of insulated wires in an essentially flat parallel configuration and extends through the connector to allow the ends of the insulated wires to protrude from its remote end, the connector also having a plurality of metal contacts supported in a movable relation perpendicular to the insulated wires; a crimping tool having jaws closable both for crimping the connector to support the insulated wires against longitudinal stress and also for causing the metal contacts to pierce insulation coverings of and conductively engage respective wires in the connector; and a cutting blade supported on the crimping tool and operable during the closing action of the jaws for cutting off the protruding ends of the wires.

8 Claims, 6 Drawing Sheets

TWISTED-PAIR DATA CABLE WITH ELECTRICAL CONNECTOR ATTACHED

This Appln claims the benefit of Provisional Appln No. 60/024,593 filed Aug. 26, 1996.

FIELD OF THE INVENTION

This invention relates to installaton of wiring in electronic circuits that transmit data signals at very high rates.

BACKGROUND OF THE INVENTION

In data circuits for transmitting electronic signals at very high rates it has been necessary to convert the twisted-pair wiring of cable endings into flat-wired connections secured in a physical connector. When performing that operation it has been necessary to minimize the length of the flat wiring configuration as far as possible, so as to reduce cross-talk between circuits.

It has been the practice for the technician to remove the outer jacket insulation from an end portion of the cable, then to straighten out the protruding twisted wires each of which carries its separate insulation into a flat lateral configuration, and then to cut off the protruding wires and insert them into a connector. The connector is then crimped in order to securely attach the wires to respective terminals therein.

SUMMARY OF THE INVENTION

According to the invention an electrical connector which may be used in telephony and data applications for connecting a multi-pair electrical cable to an outlet has openings such that the wires can extend through it before they are cut off. The outer jacket insulation is removed from an end portion of the cable. The wires are arranged in an essentially flat configuration and inserted longitudinally into and through the connector, so that the respective wires extend through separate tracks and their end portions protrude from the forward end of the connector. The protruding wire ends are then compared with a standard to confirm the correct color identification pattern for them. After the comparison is made, the protruding wire ends are crimped/secured and sheared off.

According to the invention a novel crimping and shearing tool is provided, which crimps the connector so as to securely attach the wires to respective terminals therein, and at the same time shears off the protruding wire ends.

One advantage of the invention is that the protruding wire ends can be held and the electrical connector may be pulled tight before the wires are cut off, so as to minimize the length of straight wires on the input side of the connector, thus minimizing the cross-talk problem.

A further advantage of the invention is that the comparison of color codes of the protruding wire ends provides the technician a chance to correct any error that may have been made in establishing the sequence of wires within the connector. Thus, the error rate for erroneous connections is reduced.

Yet a further advantage of the invention is that less skill is required in order to correctly terminate the wires of a cable in a connector.

DRAWING SUMMARY

DESCRIPTION OF PRIOR ART

Figure 4:
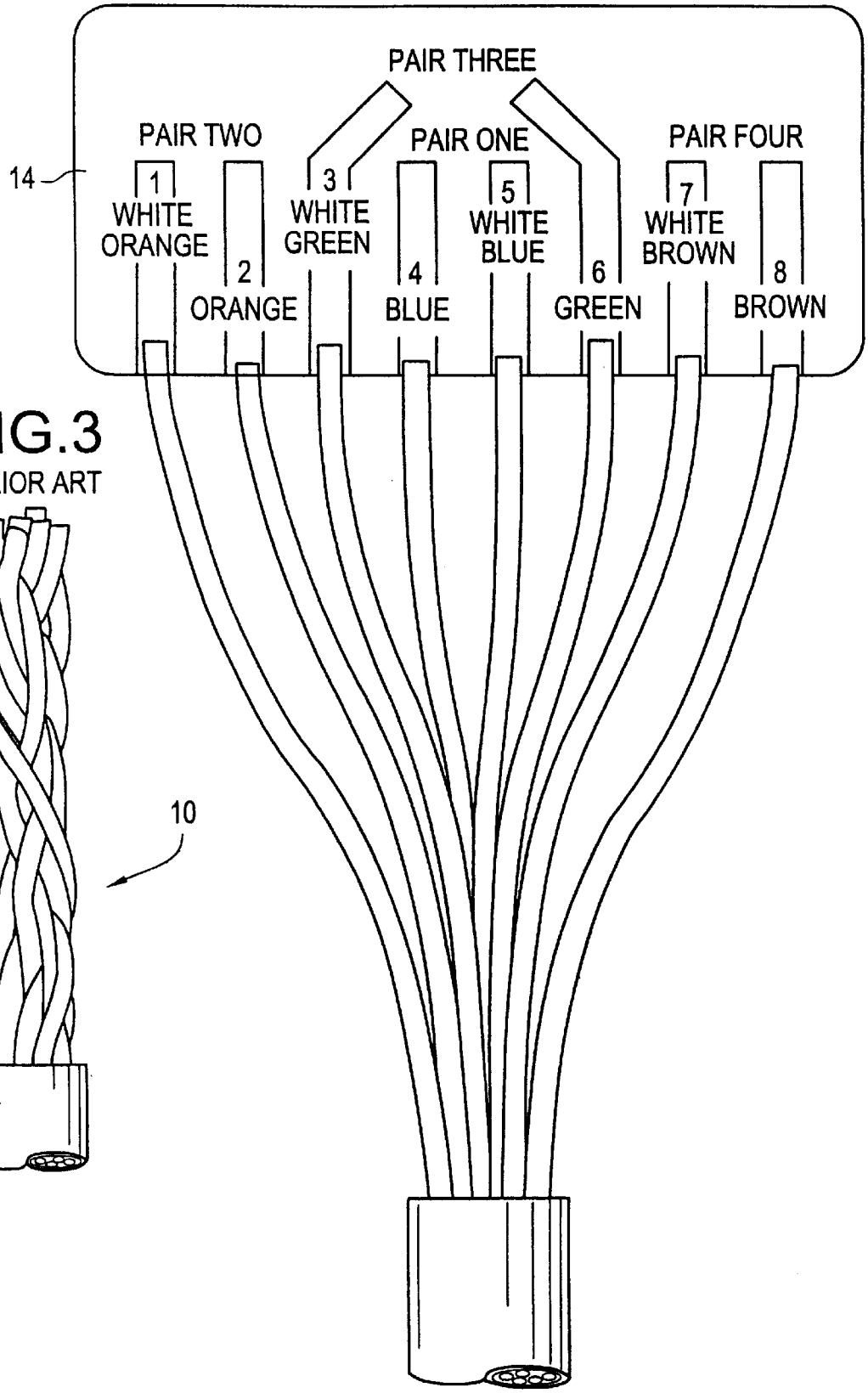
FIG.4 PRIOR ART
FIG. 4 is a plan view of a prior art fastener showing tracks into which the wire ends are inserted.
Figure 3:
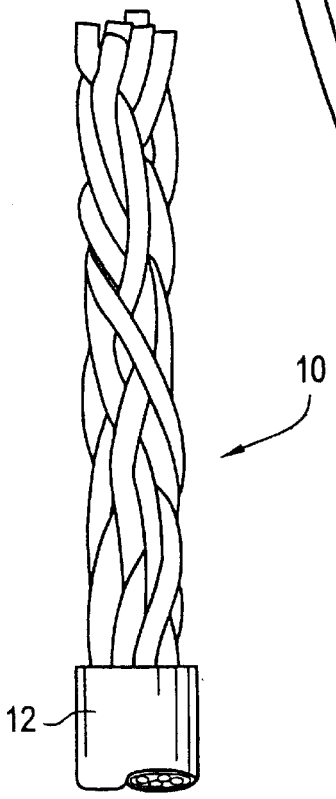
FIG.3 PRIOR ART
FIG. 3 shows a cable end carrying twisted-pair circuits with some of the insulating jacket removed before they are straightened into a flat configuration.

FIGS. 3 and 4

FIG. 3 shows a cable 10 that includes twisted-pair circuits. The outer insulation jacket 12 has been removed from an end portion of the cable, so that the individual wires may be straightened into a flat configuration, not specifically shown in FIG. 3. Although not specifically shown in that figure, the various wires of the cable have respectively different color codes. According to prior art methods the wires are straightened and are laid out in a side-by-side relationship that corresponds to a standard connector as shown schematically in FIG. 4. Then the ends of all the wires are cut off square with a hand-operated cutting tool, and all the wires are inserted at the same time into the tracks of the connector. FIG. 4 is a schematic plan view of a prior art fastener 14 showing the wire ends having thus been inserted into corresponding tracks of the fastener. As shown in FIG. 4, conductors 1 through 8 having different color codes are arranged in pairs One through Four.

A problem of the prior art technique is that the technician cannot clearly see or control the wire ends as they are inserted into the connector. It is therefore difficult to assure that the wires are arranged in a lateral sequence that correctly conforms the arrangement of the wires to the coding of terminals in the connector. A fairly high error rate is commonly experienced in making such connections.

DETAILED DESCRIPTION OF PREFERRED EMBODIMENT

FIGS. 1–3 and 5–9

Figure 1:
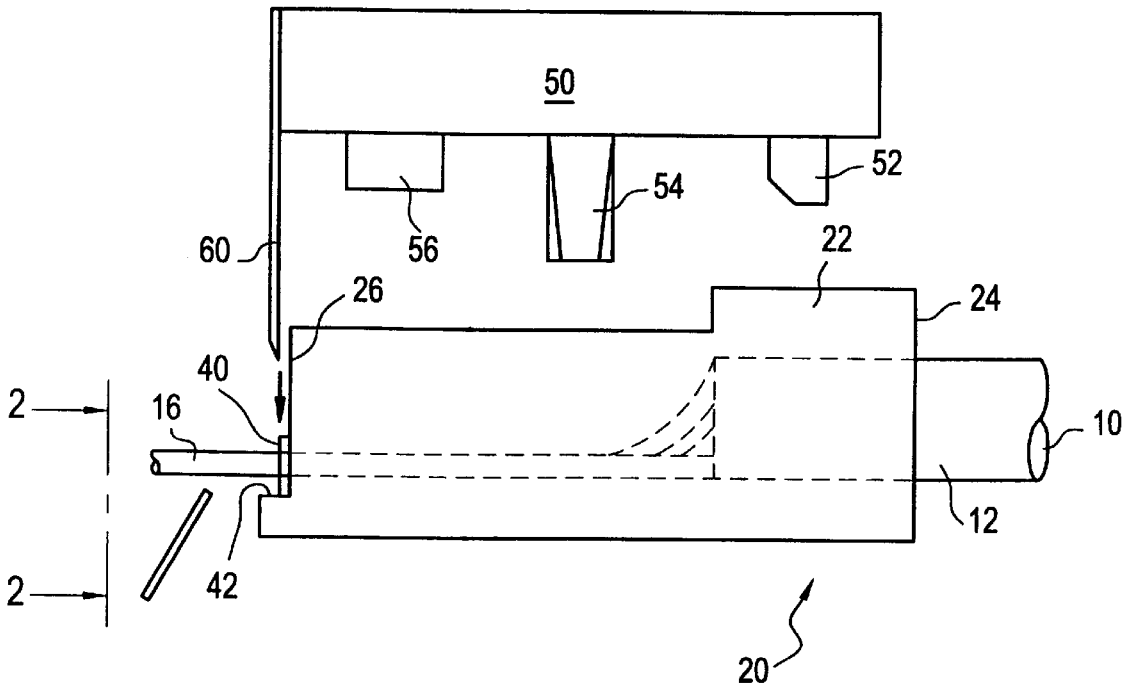
FIG. 1 is a schematic drawing of a connector and the upper part of a combined crimping and cutting tool in accordance with the invention.

FIG. 1 schematically illustrates both the novel method and the novel apparatus of the present invention. As shown in FIG. 1 an electrical connector 20 receives the end of a cable 10, and is adapted to be crimped by a crimping and shearing tool of which only the upper jaw 50 is shown. Downward movement of the jaw 50 will also shear off the protruding ends of the separate wires 16.

Figure 5:
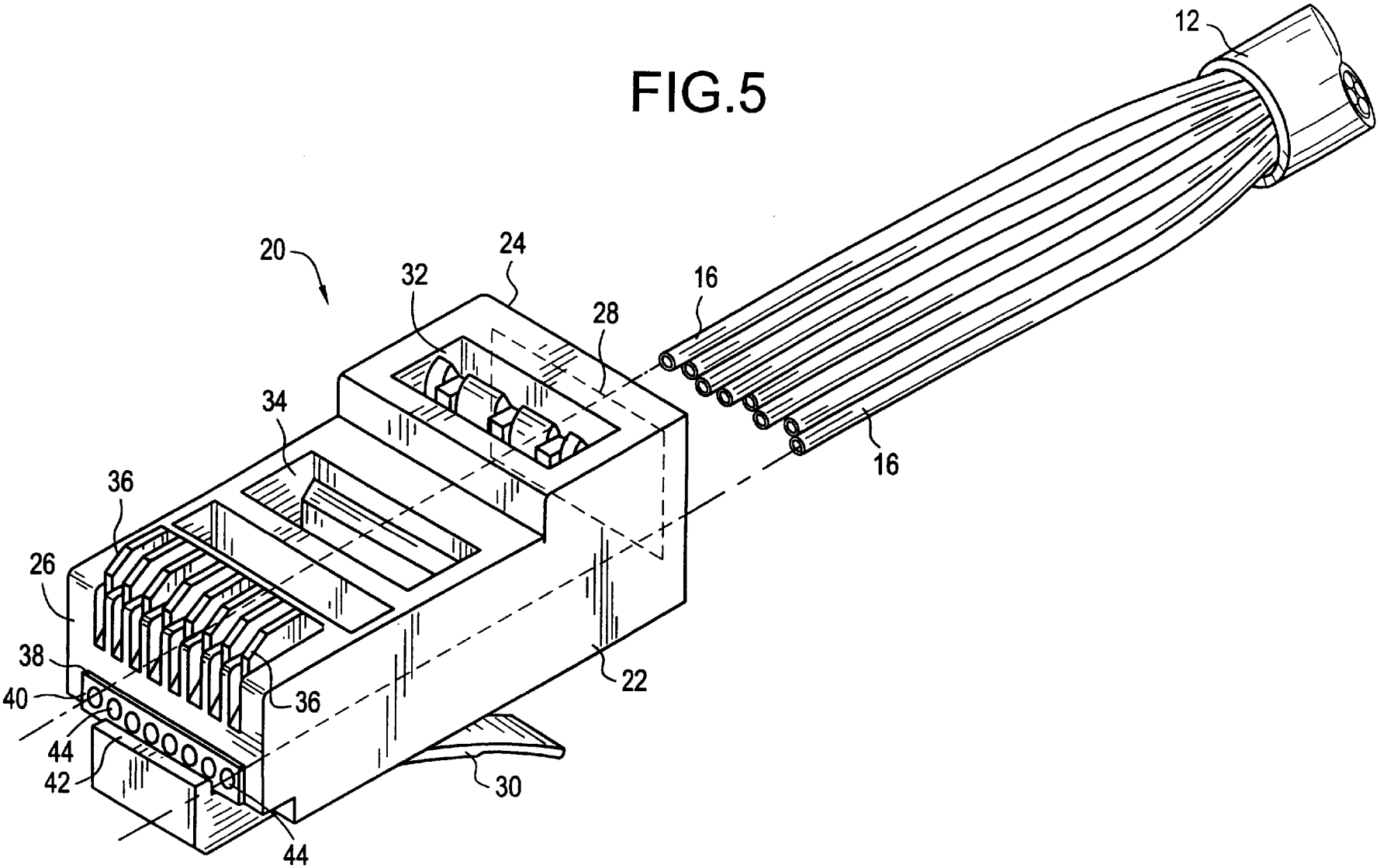
FIG. 5 is a perspective view of the novel connector provided in accordance with the present invention, and also showing the straightened wires of a cable ready to be inserted into and through the connector.

Before further describing FIG. 1, however, reference is now made to FIG. 5 which illustrates the connector 20 about to receive the prepared end of cable 10. As shown in FIG. 5, according to the present invention the length of insulating jacket 12 of cable 10 that is removed is somewhat greater than in the prior art technique, in order to allow the wire ends to protrude through the connector. The electrical connector 20, which may be used in telephony and data applications for connecting a multi-pair electrical cable to an outlet, includes a plastic housing 22 having an input end 24 and an output end 26. An input opening 28 which is provided for receiving a plurality of insulated wires in an essentially flat parallel configuration extends through the housing and divides into parallel separate tracks for the respective wires which allow the ends 16 of the insulated wires to protrude from its output end.

A control tab 30 is provided on the bottom of the generally rectangular housing of the connector, for releasably latching it into an outlet, in a well known manner. The rearward end portion of the connector is somewhat thicker than the remainder of it, and on its upper surface there is a first recess 32 adapted for receiving a crimping force. A second recess 34 is located at about the longitudinal center of the connector, also for receiving a crimping force. The front end portion of the connector supports a plurality of metal contact plates 36 which are in spaced parallel relation, and which are supported in the housing in perpendicularly movable relation to the spaces that will become occupied by the insulated wires. The housing is crimpable and is adapted in response to the crimping action to cause the metal contacts to pierce the insulation coverings of and conductively engage the respective wires.

On its output or forward end the housing 22 has a flat face plate 38 which has a flat face 40 that is perpendicular to the longitudinal axis of the connector. Below the flat face 40 is a horizontal anvil surface 42. There are a horizontal row of eight openings 44 in the flat face 40, which represent the ends of the respective wire tracks inside the housing.

Referring now again to FIG. 1, upper jaw 50 of the crimping and shearing tool has a first downward protrusion 52 that will create a first strain relief by engaging first recess 32 of the connector. Near its longitudinal center it has a second downward protrusion 54 that will engage second recess 34 at the longitudinal center of the connector. Near its forward end, the jaw 50 has a third downward protrusion 56 that will drive the metal contacts 36 down. The tool is provided with a closing mechanism, shown only schematically in FIG. 6, for moving the upper jaw 50 downward in exact parallel relation to the longitudinal axis of the housing 22 of connector 20. On the forward end of jaw 50 is a shearing blade 60 that will wipe the flat face 40 of the connector when the jaw is closed.

FIG. 1 also shows, in dotted lines, that a portion of the cable insulating jacket 12 is inserted into the input end of the connector, underneath the first recess 32, and then the wires lay out flat in a laterally spaced arrangement. The wire ends 16 extend through openings 44 in face plate 38, and the orientation of the upper jaw 50 of the crimping and shearing tool is such that its shearing blade 60 will pass over the face 40 of that face plate for shearing off the wire ends.

Figure 8:
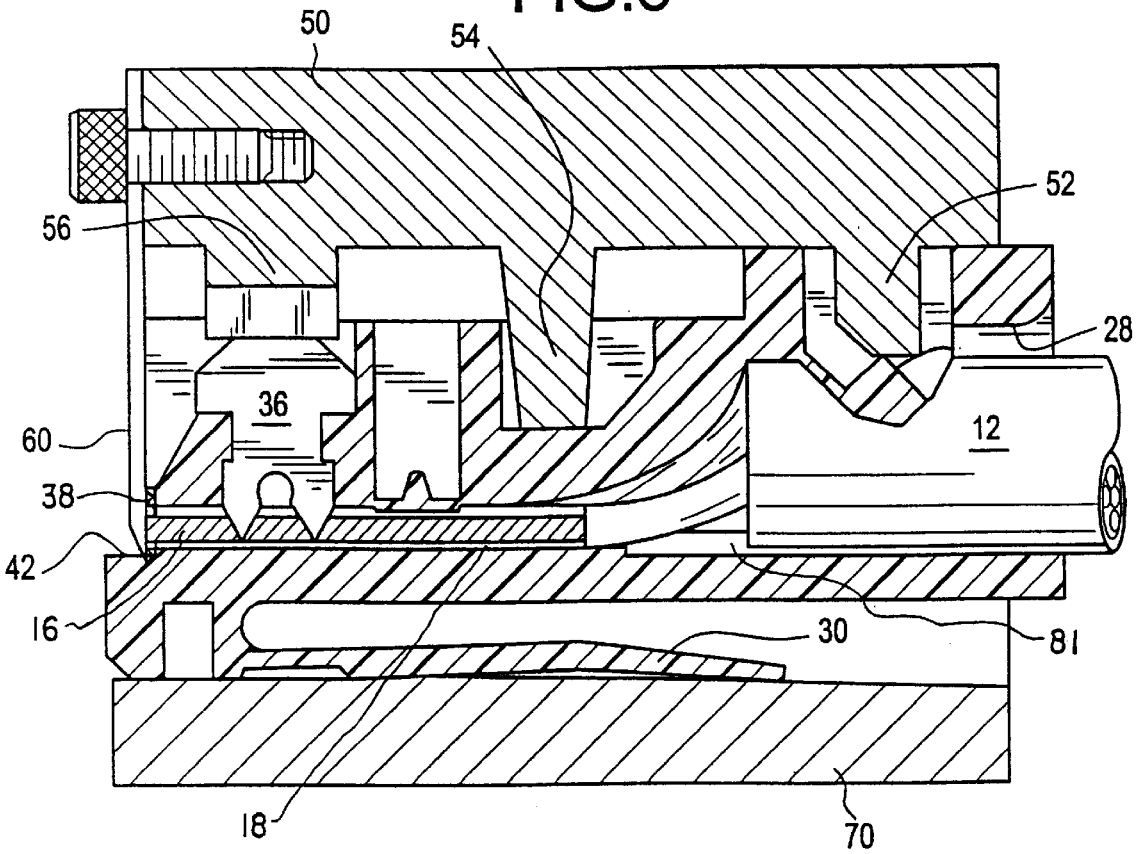
FIG. 8 is a vertical cross-sectional view taken on the line 8—8 of FIG. 7.

As more clearly shown in FIG. 8, there is a longitudinal space 81 in the connector housing 22 where the twisted pairs of insulated wires 16 extend beyond the insulating jacket 12 of the cable 10 and then lie in an untwisted configuration. The end portions of individual insulated wires 16 are then in a flat parallel horizontal relationship, occupy respective openings 44 at the output end of connector housing 22, and terminate at the flat end face 40 of flat plate 38 on the output end of housing 22. In FIG. 8 an individual wire track is now identified by a reference numeral 18.

When the upper jaw of the tool comes down, the first protrusion 52 causes the plastic material of the connector to deform so as to squeeze the full thickness of cable 10, including its insulating jacket 12. The second protrusion 54 comes down where the wires have already been laid flat, and hence presses on the individual insulations of the individual wires. The purpose of the third protrusion 56 is to drive down the metal contacts 36, not shown in FIG. 1, but which are shown in FIGS. 5, 6, 8, and 9.

Figure 2:
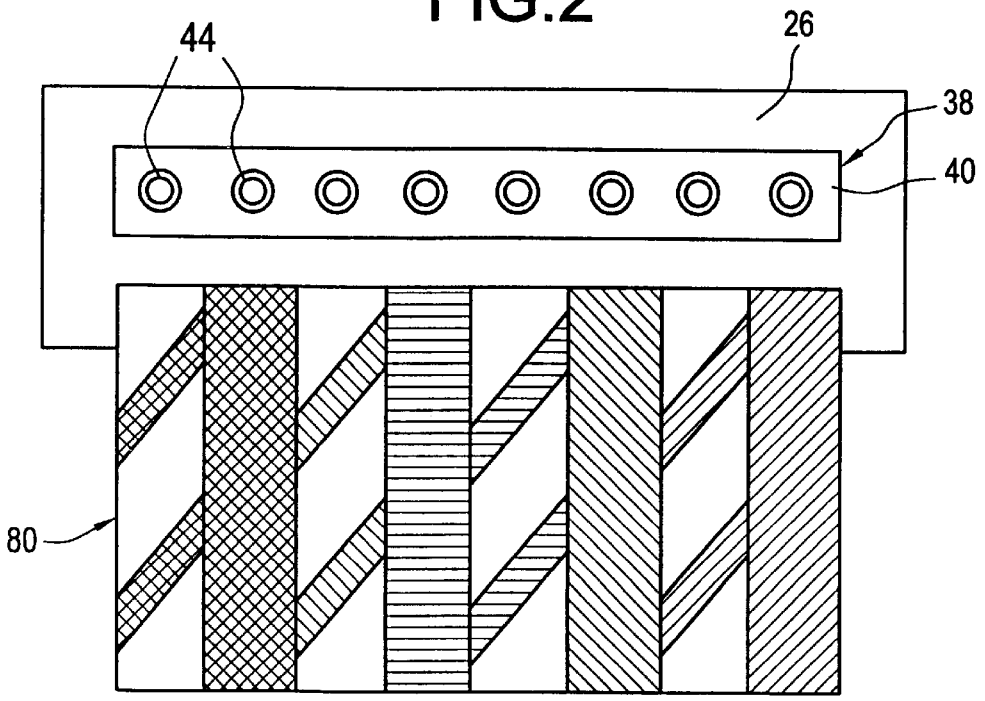
FIG. 2 is an end elevation view taken on Line 2—2 of FIG. 1, showing how the protruding wire ends may be compared to a color standard before they are cut.

Also shown in FIG. 2 is a color comparison member 80, which is in the form of a flat rectangular board having eight different color stripes on its upper surface. Before applying a downard force to crimp and cut off the wire ends, the technician can visually compare the colors of the wire ends with the corresponding colors on the comparison board, as best indicated in FIG. 2. If identifying symbols other than colors are used for the wires, then the comparison board 80 will carry a set of such symbols.

An advantage of the invention is that the protruding wire ends can be held and the electrical connector may be pulled tight before the wires are cut off, so as to minimize the length of straight wires on the input side of the connector, thus minimizing the cross-talk problem.

Thus, the housing has means for guiding the insulated wires when inserted into its input opening 28 so that all of the wire ends occupy a straight flat configuration, as is well known in the art. According to the invention, the wires will also protrude from its output end in a substantially flat configuration. Although FIG. 8 shows only one such track for guiding one of the insulated wires, it will be understood that there are in fact eight parallel tracks leading to the row of eight output openings 44. The housing is also adapted in response to the crimping action to support the insulated wires against longitudinal stress, as is conventional in such connectors.

Furthermore, the housing 22 at its output end 26 has a flat face 40 that is substantially perpendicular to the output end openings 44 of the parallel separate tracks for guiding the shearing blade 60 to cut off the protruding ends of the wires. Below the flat face portion 40 is a horizontal anvil surface 42, formed as an end portion of the control tab 30, to halt downward movement of the wire ends when the shearing blade pushes them downward, and to ensure shearing of the wires at that point.

Figure 6:
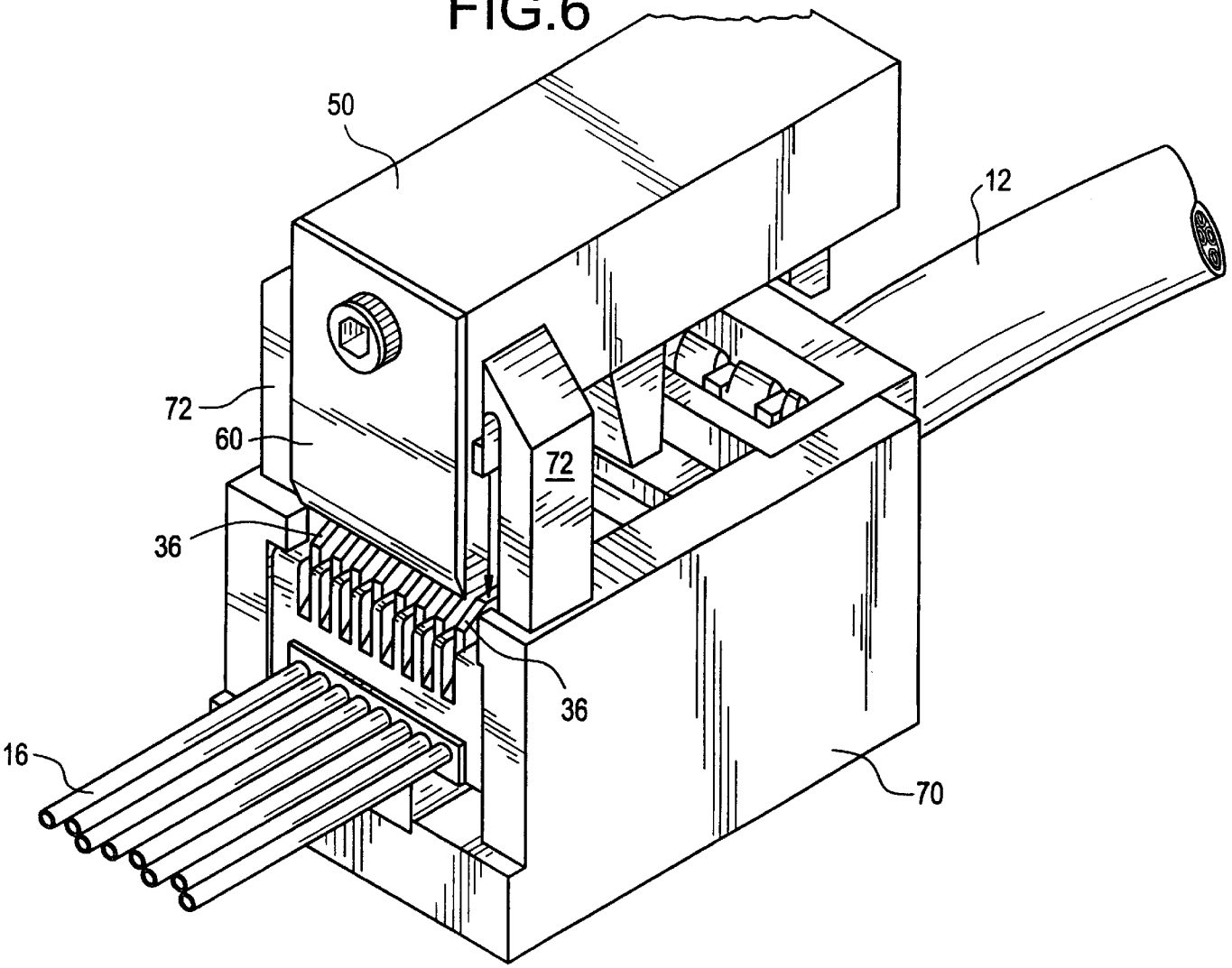
FIG. 6 is a perspective view of the novel connector of FIG. 5 after the straightened cable wires have been inserted through it, and one type of crimping and shearing tool that may be used to cut them off.
Figure 7:
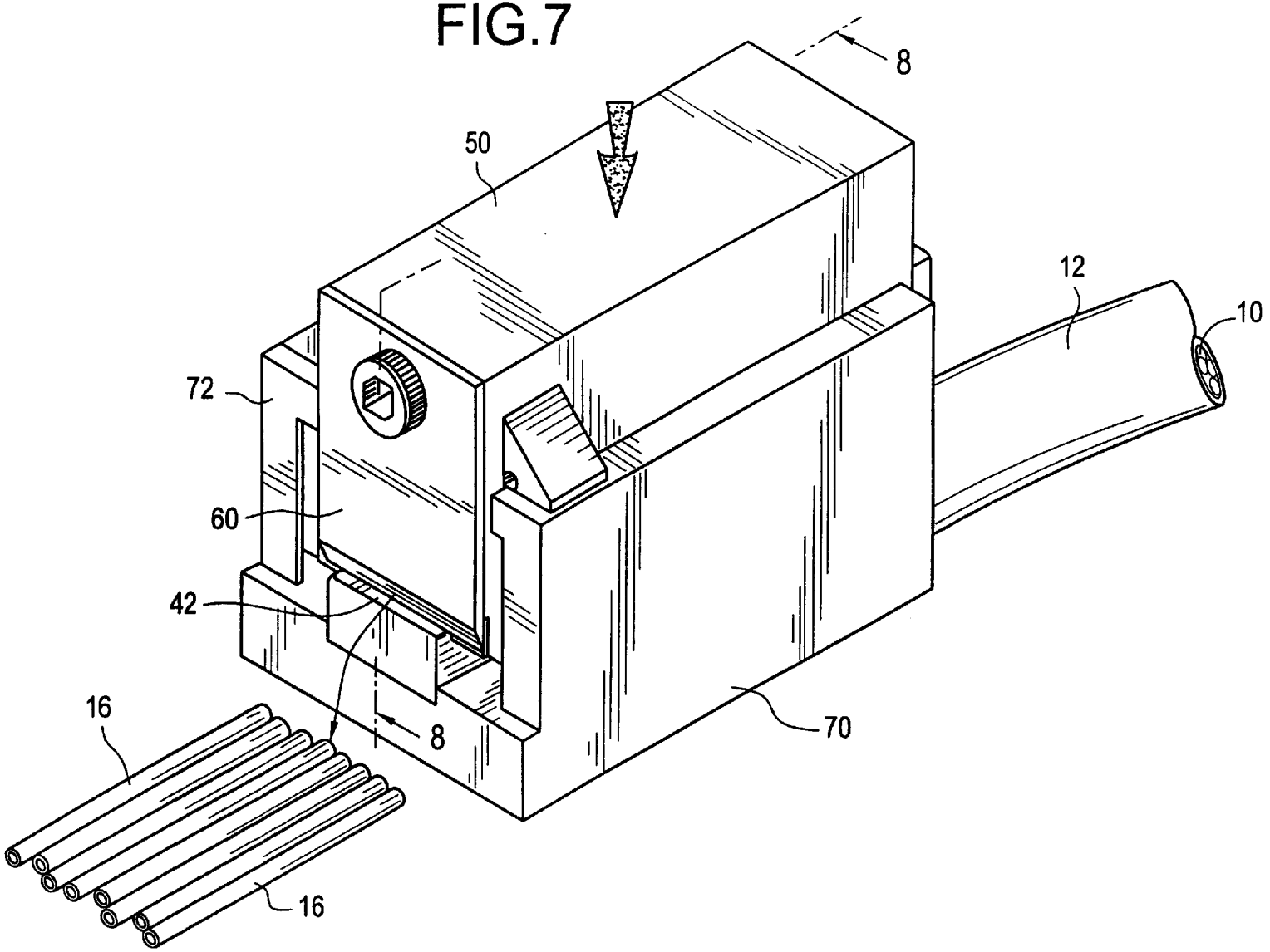
FIG. 7 is a view like FIG. 6, showing the crimping and cutting tool in a closed position and the ends of the wires after they have been cut off.

As shown in FIG. 6, according to the invention a crimping tool, in addition to the upper jaw 50, also has a lower jaw 70 for holding the connector from its under side for positioning the connector in a predetermined position relative thereto. Guide posts 72 guide the downward movement of the upper jaw 50, for crimping the connector housing 22 to support the insulated wires therein against longitudinal stress and also for causing the metal contacts 36 in the connector to pierce insulation coverings of and conductively engage respective wires in the connector. Various different designs of the crimping and shearing tool may use different mechanisms for guiding the closing action of the jaws, as is well known in the art.

The present invention reduces the working time of the technicians. It also makes it possible for a person with less skill to do the job, because of symbol code comparison, pulling the wires through, plus being able to work with longer length of wire. In prior art, it was necessary to cut off the wires too short, then put them into the connector. With the present invention, the technician has conveniently long wires to work with, and can easily see what he is doing before cutting off the ends. This reduces the need for a circuit tester, because of much lower risk of error in connecting the wires. It also saves material by minimizing the need to throw away incorrectly wired connectors.

Although the present invention has been illustrated with regard to a cable having eight wires providing four pairs, it will be understood that the invention will apply to any cable having two or more wire pairs.

Figure 9:
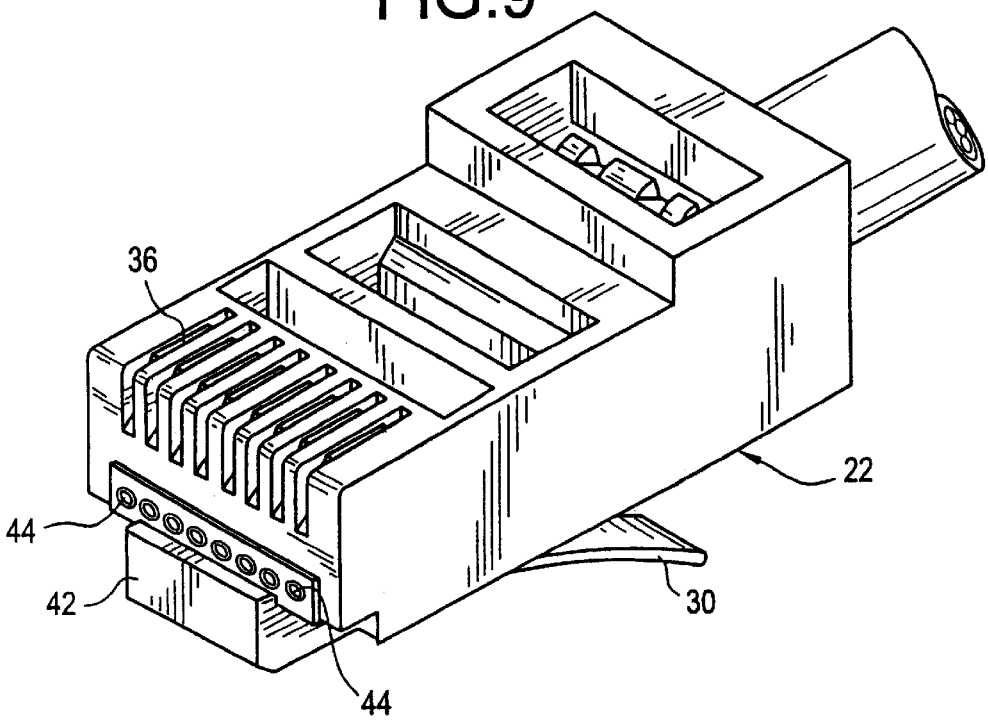
FIG. 9 is a perspective view of my novel connector by itself after the protruding wire ends have been cut off.

As shown in FIG. 9, the anvil 42 extends across underneath only six of the protruding wires, leaving the two end wires 16 outside its scope. The anvil may be of lesser length than the row of holes 44, as shown, or may be of equal or greater length. Further, although the anvil surface 42 is presently formed as an end portion of the control tab 30, it may if desired be provided as part of the lower jaw 70.

Although the presently preferred form of the invention has been disclosed in detail in order to comply with the patent laws, it will be understood that the scope of the invention is to be judged only in accordance with the appended claims.

What I claim is:

1. An electrical cable and connector for use in data applications, comprising:

the cable having a jacket encasing a plurality of twisted pairs of insulated wires with insulation coverings;

the connector having a crimped housing with input and output ends, an opening at the input end of the housing receiving the cable jacket, a plurality of internal tracks within the housing for receiving and guiding each of the wires individually, and a longitudinal space within the housing between the input opening and the tracks wherein the twisted pairs of insulated wires are untwisted;

the tracks having separate exit openings at the output end of the housing in a flat horizontally aligned configuration through which ends of the wires protrude prior to being sheared off;

the housing being crimped for supporting both of the cable jacket and wires against a longitudinal stress imposed on the cable;

a plurality of metal contacts supported in the housing and piercing the insulation coverings of and conductively engaging corresponding wires in the tracks;

the output end of the housing having a flat end face that is substantially perpendicular to the exit openings of the tracks; and the individual wires within the housing having been pulled tight from their protruding ends, prior to the housing being crimped and the protruding wire ends being sheared off so as to minimize the length of untwisted wire inside the housing by pulling the untwisted wires close and tight together in parallel, thus minimizing cross-talk between wire pairs.

2. A cable assembly for data applications, comprising:

a connector including a housing having input and output ends, an opening at the input end of the housing, and a flat end face at the output end of the housing with a horizontal row of openings therein;

an electrical cable containing a plurality of twisted pairs of separately insulated wires and in which each wire has a distinctive identification symbol, the wires each having an insulation covering, the wire pairs being surrounded by an insulating jacket;

the insulating jacket of the cable being received within the opening in the input end of the housing;

the twisted pairs of insulated wires extending beyond the insulating jacket of the cable and lying untwisted in a tight parallel relationship in a longitudinal space within the connector, end portions of the individual wires then being in a flat parallel configuration, occupying respective openings at the output end of the housing, and terminating at the flat end face of the housing;

the connector further including a plurality of metal contacts supported in the housing in conductive engagement with respective individual wires of the untwisted insulated wires the longitudinal space being located between the input end and the metal contacts; and the housing having been crimped to support both the insulating jacket of the cable and the individual insulated wires therein against longitudinal stress imposed on the cable, and also to hold the metal contacts in conductively piercing engagement through the insulation coverings of the respective wires.

3. A connector and cable assembly for data applications, comprising:

a connector including a deformable housing having input and output ends, an opening at the input end of the housing, and a flat end face at the output end of the housing with a horizontal row of openings therein;

an electrical cable containing a plurality of twisted pairs of separately insulated wires, the wire pairs being surrounded by an insulating jacket, the insulating jacket of the cable being truncated and received within the opening in the input end of the housing;

the twisted pairs of insulated wires extending beyond the insulating jacket of the cable, the connector housing having a longitudinal space within which the twisted wires are received untwisted and a further extension of the wires lying untwisted within the connector with end portions in a flat parallel configuration and terminating at respective openings at in the flat end face of the housing;

the housing being crimped to support both the insulating jacket of the cable and the individual insulated wires therein against longitudinal stress imposed on the cable.

4. An assembly as in claim 3 in which the connector further includes a plurality of metal contacts supported in the housing in conductive engagement with respective insulated wires.

5. An assembly as in claim 3 wherein the individual wires within the housing having been pulled tight from protruding ends thereof, prior to the housing being crimped and the protruding wire ends being sheared off, so as to minimize the length of untwisted wire inside the housing by pulling the untwisted wires close and tight together in parallel and thus minimize cross-talk between wire pairs.

6. An electrical cable and connector assembly for use in data applications, comprising:

a connector including a housing having input and output ends, an opening at the input end, and an internal shoulder;

an electrical cable containing a plurality of twisted pairs of separately insulated wires and encased within an insulating jacket, the insulating jacket having a forward end received within the opening in the input end of the housing and abutting the internal shoulder, the insulated wires extending beyond the internal shoulder;

the housing having a longitudinal space beyond the internal shoulder wherein the twisted pairs of insulated wires are untwisted, a plurality of internal tracks receiving and guiding the untwisted wires individually, the tracks being located between the longitudinal space and the output end and a flat end face at the output end of the housing having separate exit openings wherein the wires terminate, the exit openings being aligned in a single row in a flat parallel configuration;

the connector further including a plurality of metal contacts supported in the housing in conductive engagement with respective wires of the insulated wires; and the housing having been crimped to support both the insulating jacket of the cable and the individual insulated wires therein against longitudinal stress imposed on the cable, and also to hold the metal contacts in conductively piercing engagement with the respective wires through their insulation coverings.

7. The assembly of claim 6 wherein end portions of the untwisted wires occupy a flat parallel configuration with ends thereof terminating at respective openings in the flat end face of the housing, and wherein the connector further includes an anvil on the output end of the housing aligned parallel to the plane of the exit openings.

8. The assembly of claim 6 wherein the individual wires within the housing having been pulled tight from protruding ends thereof, prior to the housing being crimped and the protruding wire ends being sheared off, so as to minimize the length of untwisted wire inside the housing by pulling the untwisted wires close and tight together in parallel, thus minimizing cross-talk between wire pairs.

* * * * *